US009613608B2

(12) United States Patent
Osuga et al.

(10) Patent No.: US 9,613,608 B2
(45) Date of Patent: Apr. 4, 2017

(54) KEYBOARD UNIT

(71) Applicant: YAMAHA CORPORATION, Hamamatsu-shi, Shizuoka (JP)

(72) Inventors: Ichiro Osuga, Hamamatsu (JP); Hiroshi Harimoto, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/014,349

(22) Filed: Feb. 3, 2016

(65) Prior Publication Data

US 2016/0225360 A1 Aug. 4, 2016

(30) Foreign Application Priority Data

Feb. 4, 2015 (JP) ..... 2015-020120

(51) Int. Cl.
*G10H 1/34* (2006.01)
*G10H 1/18* (2006.01)

(52) U.S. Cl.
CPC ..... *G10H 1/344* (2013.01); *G10H 1/182* (2013.01); *G10H 1/34* (2013.01); *G10H 2220/271* (2013.01); *G10H 2220/281* (2013.01); *G10H 2220/291* (2013.01); *G10H 2230/011* (2013.01)

(58) Field of Classification Search
CPC ..... G10H 1/34
USPC ..... 84/720
See application file for complete search history.

(56) References Cited

U.S. PATENT DOCUMENTS 3,536,819 A * 10/1970 Kuriyagawa ..... G10H 1/344 84/679
3,794,747 A * 2/1974 Obayashi ..... G10H 1/182 84/655
4,031,797 A * 6/1977 Schmoyer ..... G10G 1/02 84/470 R
4,416,178 A 11/1983 Ishida
5,079,985 A * 1/1992 Yamaguchi ..... G10C 3/12 84/719

(Continued)

FOREIGN PATENT DOCUMENTS

JP S57104994 A 6/1982
JP H07104737 A 4/1995

(Continued)

OTHER PUBLICATIONS

Notice of Allowance issued in U.S. Appl. No. 15/013,373, mailed Aug. 30, 2016.

(Continued)

*Primary Examiner* — David Warren
(74) *Attorney, Agent, or Firm* — Rossi, Kimms & McDowell LLP

(57) ABSTRACT

A keyboard unit includes: a key; a plurality of members which include the key, and each of which has an engaged section for forming an engaged state, the engaged state changed by turning of the key, at least a portion of the engaged section formed of a conductor; a detector which is configured to detect information on the engaged state of the plurality of members by detecting a conduction state between the at least portions of the engaged sections which are in contact with each other; and a determiner which is configured to determine a musical sound parameter based on a detection result of the detector.

20 Claims, 8 Drawing Sheets

(56) References Cited

U.S. PATENT DOCUMENTS

| | | | | |
|---|---|---|---|---|
| 5,237,123 | A | 8/1993 | Miller | |
| 5,512,705 | A | 4/1996 | Kobayashi | |
| 5,612,502 | A * | 3/1997 | Ura | G10H 1/344 84/171 |
| 5,679,914 | A | 10/1997 | Niitsuma | |
| 5,691,489 | A | 11/1997 | Fujiwara | |
| 5,731,530 | A | 3/1998 | Fujiwara | |
| 5,739,450 | A | 4/1998 | Fujiwara | |
| 5,763,799 | A * | 6/1998 | Kimble | G10H 1/346 84/433 |
| 5,977,466 | A * | 11/1999 | Muramatsu | G10H 1/346 84/433 |
| 5,986,202 | A * | 11/1999 | Seiler | G10H 1/346 84/18 |
| 6,051,762 | A | 4/2000 | Fujiwara | |
| 6,191,351 | B1 * | 2/2001 | Niitsuma | G10H 1/346 84/423 R |
| 6,297,437 | B1 | 10/2001 | Ura | |
| 6,365,820 | B1 | 4/2002 | Kondo et al. | |
| 6,765,142 | B2 * | 7/2004 | Sakurada | G10H 1/346 84/600 |
| 7,214,897 | B2 * | 5/2007 | Chuang | H01H 13/83 200/314 |
| 7,361,827 | B2 | 4/2008 | Sasaki | |
| 7,408,108 | B2 * | 8/2008 | Ludwig | G10H 1/00 84/718 |
| 7,423,867 | B2 * | 9/2008 | Yamamoto | G07C 9/00944 340/502 |
| 7,432,430 | B2 | 10/2008 | Sasaki | |
| 7,820,902 | B2 | 10/2010 | Furukawa | |
| 7,902,449 | B2 | 3/2011 | Furukawa | |
| 7,960,629 | B2 | 6/2011 | Sasaki | |
| 2002/0046640 | A1 | 4/2002 | Kondo | |
| 2005/0145104 | A1 | 7/2005 | Sasaki | |
| 2006/0048624 | A1 | 3/2006 | Sasaki | |
| 2006/0054010 | A1 | 3/2006 | Sasaki | |
| 2006/0065103 | A1 | 3/2006 | Sasaki | |
| 2007/0039452 | A1 | 2/2007 | Nishida | |
| 2007/0169608 | A1 | 7/2007 | Fujiwara | |
| 2007/0221036 | A1 | 9/2007 | Fujiwara | |
| 2009/0084248 | A1 | 4/2009 | Furukawa | |
| 2009/0100979 | A1 | 4/2009 | Furukawa | |
| 2010/0229707 | A1 | 9/2010 | Sasaki | |
| 2010/0288102 | A1 | 11/2010 | Fujiwara | |
| 2010/0294108 | A1 | 11/2010 | Shin | |
| 2011/0132182 | A1 | 6/2011 | Kikumoto | |
| 2013/0152769 | A1 * | 6/2013 | Suzuki | G10H 1/34 84/719 |
| 2014/0069262 | A1 | 3/2014 | Cheever | |
| 2016/0225359 | A1 | 8/2016 | Osuga | |
| 2016/0225360 | A1 * | 8/2016 | Osuga | G10H 1/344 |

FOREIGN PATENT DOCUMENTS

| | | | |
|---|---|---|---|
| JP | H08101687 | A | 4/1996 |
| JP | 09120286 | A | 5/1997 |
| JP | 09120287 | A | 5/1997 |
| JP | 09120288 | A | 5/1997 |
| JP | 09120289 | A | 5/1997 |
| JP | 2001312279 | A | 11/2001 |
| JP | 2007052357 | A | 3/2007 |
| JP | 2010160263 | A | 7/2010 |
| JP | 2013210451 | A | 10/2013 |

OTHER PUBLICATIONS

Non-Final Office Action issued in U.S. Appl. No. 15/014,196, mailed Oct. 7, 2016.

Notice of Allowance issued in U.S. Appl. No. 15/013,373, mailed Nov. 18, 2016.

Office Action issued in Japanese Appln. No. 2015-020122 mailed Nov. 29, 2016. English machine translation provided.

* cited by examiner

| KEY | SW | STATE | CHANGE TIME |
|---|---|---|---|
| KEY 1 | SW1 | OFF | hh:mm:ss:xxxxx |
| KEY 2 | SW2 | ON | hh:mm:ss:xxxxx |
| ⋮ | SW3 | ON | hh:mm:ss:xxxxx |
| KEY 88 | SW4 | OFF | hh:mm:ss:xxxxx |

KEYBOARD UNIT

CROSS-REFERENCE TO RELATED APPLICATION(S)

This application is based upon and claims the benefit of priority from prior Japanese patent application No. 2015-020120, filed on Feb. 4, 2015, the entire contents of which are incorporated herein by reference.

BACKGROUND

The present invention relates to a keyboard unit in which a hammer is driven with a key by the pressing operation of the key and the hammer does not operate in synchronization with the key in the pressing/releasing strokes of the key in some cases.

Keyboard musical instruments are available in which a hammer does not operate in synchronization with a key in the pressing/releasing strokes of the key in some cases as typically in keyboard musical instruments having a hammer action or a pseudo hammer action. In this kind of musical instrument, the key and the hammer do not always operate in synchronization with each other, and the relative relationship between the key and the hammer is complicated depending on various key pressing and releasing operation modes, such as the strength and depth of key pressing operation and the timing of key releasing operation. Hence, if the motion of only one of the key or the hammer is detected and musical sound is generated electronically according to the result of the detection, the player of the musical instrument may feel uncomfortable in some cases, for example, because the timing of key pressing operation does not coincide with the timing of sound generation or the strength of pressing the key does not match the volume of the generated sound. Accordingly, keyboard musical instruments are available in which the engagement of members is detected at two or more positions and the result of the detection is reflected to musical sound control.

For example, in JP-A-9-120289, a jack tail sensor is provided on a member equivalent to a regulating button, and a jack sensor is provided on a regulating rail, to detect the timing of the contact between the member equivalent to the regulating button and a member equivalent to a jack and the timing of the contact between the regulating rail and the member equivalent to the jack. Musical sound is then controlled on the basis of the detection results of these two sensors, whereby accurate touch response is obtained.

However, in JP-A-9-120289, the sensors for detecting the timing of the contact are configured as a leaf switch formed of a hollow body made of rubber or a metal spring. Hence, the reaction forces generated by them considerably affect the feeling of pressing the key. Hence, it is desired that the feeling of pressing the key is not affected as much as possible in the case that the various operation states of the key are estimated appropriately so that the estimated states can be reflected to musical sound control and so that performance data can be generated.

SUMMARY

The presently disclosed subject matter may provide a keyboard unit capable of determining musical sound parameters by accurately estimating the state of playing operation while the influence to be exerted on the feeling of pressing the key is reduced.

The keyboard unit including a key, a plurality of component members and a hammer, as members in which an engaged state of members to be engaged with each other is changeable in pressing/releasing strokes of the key, the hammer driven by a pressing operation of the key, and the hammer not operating in synchronization with the key in the pressing/releasing strokes of the key in some cases, may comprise: a first detector, provided for a first set including: a movable member; and a corresponding member to be engageable with the movable member, which are selected from among the key, the plurality of component members and the hammer, and configured to detect an engaged state of the movable member and the corresponding member in the first set; a second detector, provided for a second set different from the first set and including: a movable member; and a corresponding member to be engageable with the movable member, which are selected from among the key, the plurality of component members and the hammer, and configured to detect an engaged state of the movable member and the corresponding member in the second set; and a determiner configured to determine a musical sound parameter for musical sound control based on a detection result of the first detector and a detection result of the second detector, wherein when engaged sections of the movable member and the corresponding member in the set corresponding to at least one of the first and second detectors are in contact with and are engaged with each other, the engaged sections become electrically conductive, and the at least one of the first and second detectors detects an engaged state of the movable member and the corresponding member depending on a state of electrical conduction between the engaged sections.

Each of the engaged sections of the movable member and the corresponding member in the set corresponding to the at least one of the first and second detectors may be made of a conductive material or an engaged region of each of the engaged sections may be provided with a conductive material.

The determiner may be configured to determine the musical sound parameter based on a timing of change in the engaged state of the movable member and the corresponding member in the first set detected by the first detector and a timing of change in the engaged state of the movable member and the corresponding member in the second set detected by the second detector.

An engagement position between the engaged sections of the movable member and the corresponding member in the set corresponding to the at least one of the first and second detectors may change depending on a relative position between the movable member and the corresponding member, and the at least one of the first and second detectors may detect change in the engaged state of the movable member and the corresponding member at a plurality of steps or continuously depending on the state of electrical conduction between the engaged sections.

The set may be a set including a jack and a hammer roller.

The set may be a set including the key and a back rail cloth.

The set may be a set including the key and a damper lever cushion.

The set may be a set including a jack and a regulating button.

The set may be a set including a front punching cloth and a front bushing cloth.

The set may be a set including a repetition lever button and a wippen.

The set may be a set including a repetition screw and a repetition lever.

The set may be a set including a hammer and a back check.

The set may be a set including a jack button and a jack.

The set may be a set including a hammer and a silencing stopper.

The set may be a set including a string and a hammer felt.

The set may be a set including a string and a damper.

The set may be a set including a bat and a jack.

The set may be a set including the key and a key back rail cloth.

The set may include four sets, and the determiner may be configured to determine the musical sound parameter depending on a combination in one of the four sets, an engaged state of which has changed.

The keyboard unit may comprise: a key; a plurality of members which include the key, and each of which has an engaged section for forming an engaged state, the engaged state changed by turning of the key, at least a portion of the engaged section formed of a conductor; a detector which is configured to detect information on the engaged state of the plurality of members by detecting a conduction state between the at least portions of the engaged sections which are in contact with each other; and a determiner which is configured to determine a musical sound parameter based on a detection result of the detector.

DETAILED DESCRIPTION OF EXEMPLARY EMBODIMENTS

An embodiment according to the present invention will be described below referring to the accompanying drawings.

Figure 1:
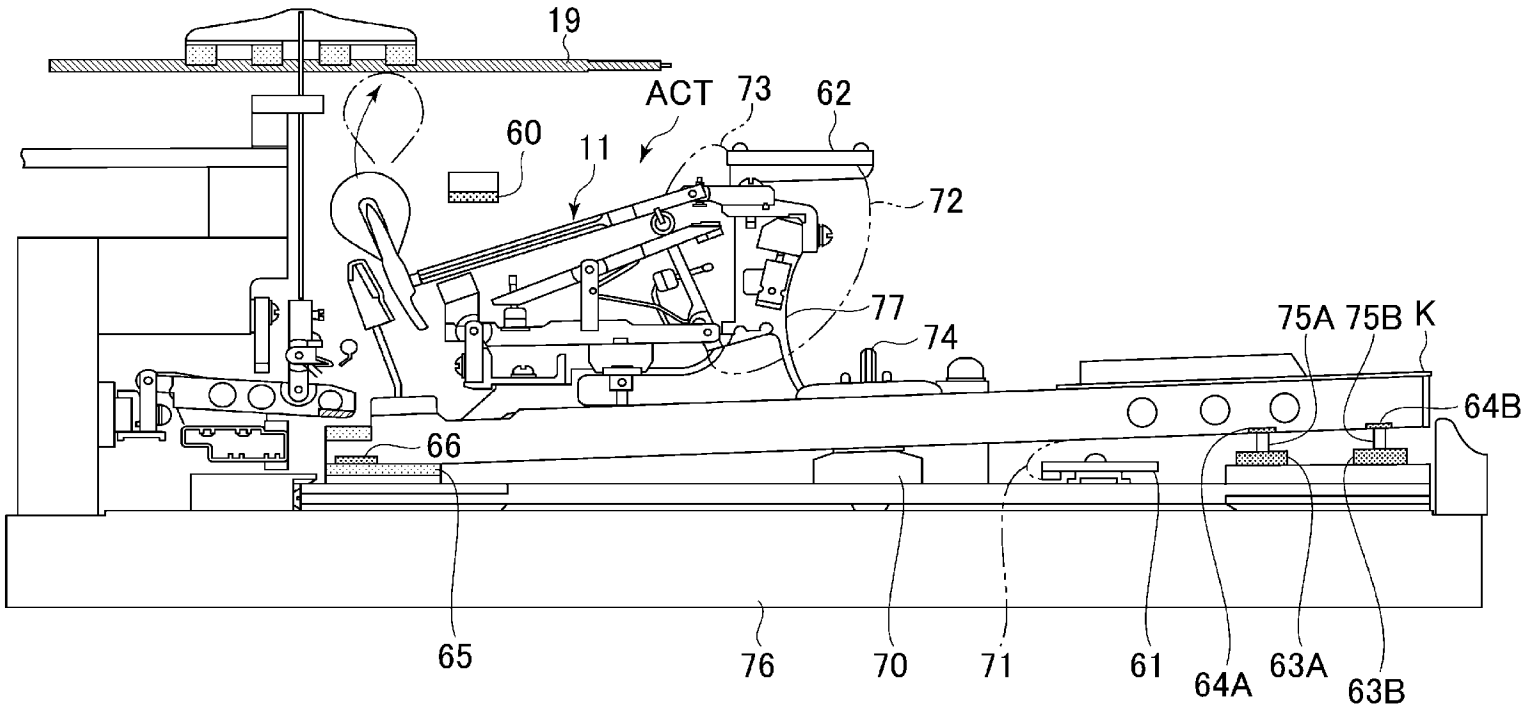
FIG. 1 is a vertical cross-sectional view showing a keyboard unit according to an embodiment of the present invention.

FIG. 1 is a vertical cross-sectional view showing a keyboard unit according to an embodiment of the present invention. FIG. 1 mainly shows the configurations of a key K and an action mechanism ACT for the key, for example.

This keyboard unit is configured as part of a grand piano type electronic keyboard musical instrument in which a plurality of keys K, white keys and black keys, are arranged in parallel. The action mechanism ACT for each key K is provided above the rear end section of the key K. Each key K is disposed so as to be rotatable clockwise and counterclockwise in FIG. 1 with a portion near a balance pin 74 at a key fulcrum section 70 being used as a fulcrum. The right side in FIG. 1 is the side of the player and the front side of the keyboard unit, and the left side is the rear side thereof. The front section of the key K is pressed and released.

This keyboard unit can generate sound using a hammer 11 that strikes a string 19 and also can generate sound electronically by detecting the movements and positions of elements in the action mechanism ACT and the like. A silencing stopper 60 is mounted such that its position is variable with respect to a base section 76 including a keyboard reed so that the position of the silencing stopper 60 can be switched by operating an operation device, not shown. In the case of a normal performance in which the string is struck, the silencing stopper 60 is placed at a position where the hammer 11 does not make contact therewith. When a performance is carried out in a silencing mode, the silencing stopper 60 is placed at a position where the hammer 11 makes contact therewith so that the hammer 11 does not make contact with the string 19.

Front bushing cloths 64A and 64B are provided at the front lower section of the key K. Front punching cloths 63A and 63B are disposed at positions corresponding to the positions of the front bushing cloths 64A and 64B. The front bushing cloths 64A and 64B are made contact with the front punching cloths 63A and 63B by key pressing operation, whereby the turning end position (end position) of the key K is restricted. The movement of the front section of each key K in the arrangement direction of the keys is restricted by front pins 75A and 75B during key pressing operation.

A conductive section 66 is provided at the rear lower section of the key K. A back rail cloth 65 is disposed on the base section 76 via a back rail under felt at the position corresponding to the conductive section 66. The rear lower face of the key K makes contact with the back rail cloth 65, whereby the conductive section 66 makes contact with the back rail cloth 65, and the initial position of the key K in the non-pressing state of the key, that is, the turning start position (rest position) of the key K, is restricted.

An electric circuit board 61 is disposed so as to be fastened to the base section 76. In addition, an electric circuit board 62 is disposed so as to be fastened to an action bracket 77. Although electric circuit boards other than these are also provided, they are not shown in the figure.

Figure 2:
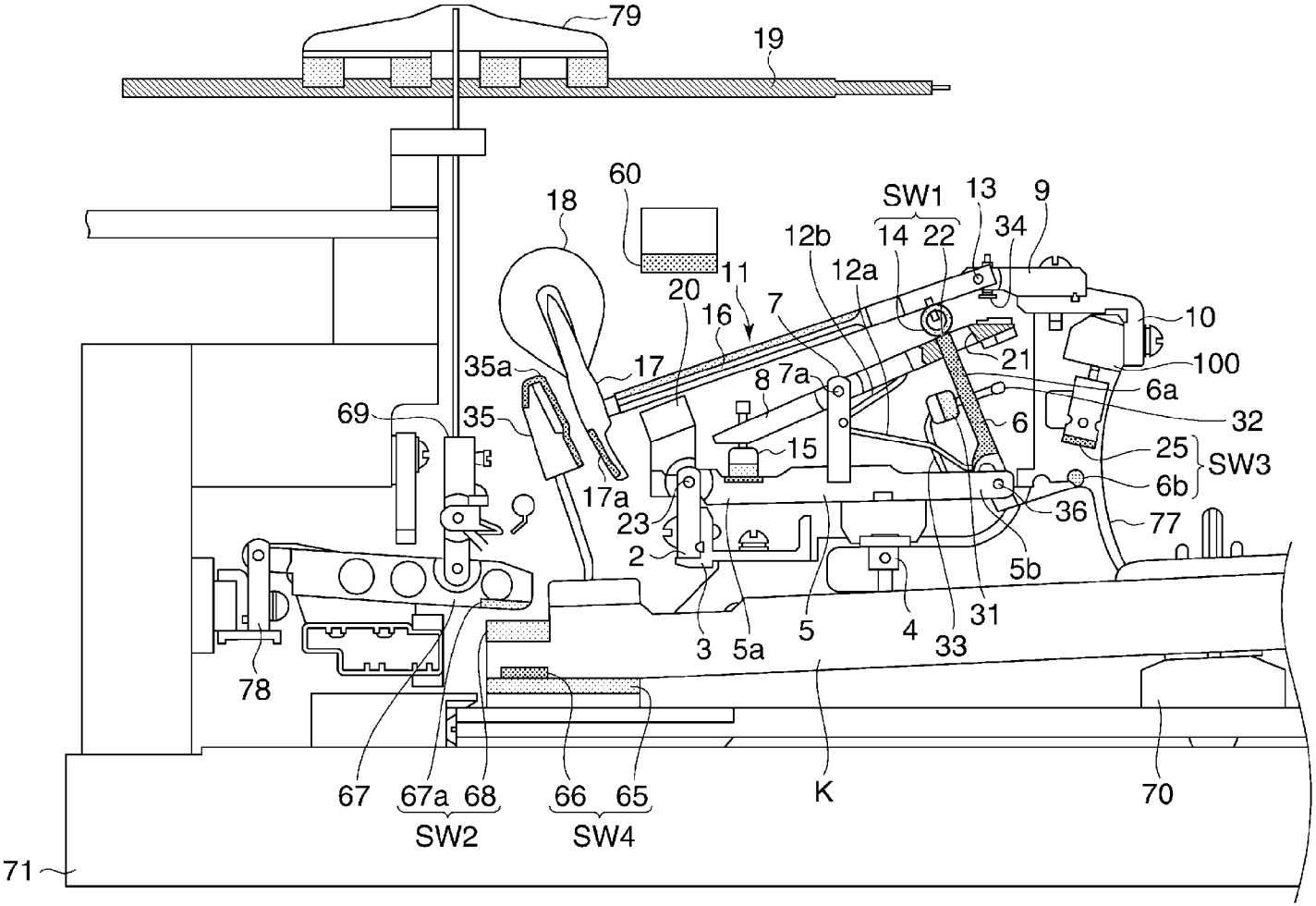
FIG. 2 is a side view showing an action mechanism and its peripheral elements.

FIG. 2 is a side view showing an action mechanism ACT and its peripheral elements.

A capstan screw 4 is implanted on the upper face of the rear end section of the key K. A back check 35 is provided at the rear end upper section of the key K. A damper lever 67 is pivotally supported by a damper lever flange 78 provided behind the key K. In addition, the damper lever 67 is pivotally supported by a damper block 69, and a damper 79 is fastened to the damper block 69.

The action mechanism ACT is mainly equipped with a wippen 5, a jack 6 and a repetition lever 8. The turning fulcrum 23 at the rear end section 5*a* of the wippen 5 is pivotally supported by a support flange 2 fastened to a support rail 3, and the front end 5*b* of the wippen 5 serving as a free end is made turnable around the turning fulcrum 23 in the up-down direction. A hammer shank stop felt 20 is disposed on the upper face of the wippen 5 on the side of the turning fulcrum 23. A jack stop 33 protrudes at the upper section of the front half section of the wippen 5.

A repetition lever flange 7 protrudes upward at the center of the wippen 5 in the front-rear direction. The repetition lever 8 is supported so as to be turnable clockwise and counterclockwise around the turning fulcrum 7*a* at the upper end section of the repetition lever flange 7. The jack 6 has a vertical section 6*a* extending nearly upward and a small jack 6*b* extending forward in a nearly horizontal direction, thereby being formed into a nearly L-shape in a side view. The jack 6 is disposed so as to be turnable clockwise and counterclockwise in FIG. 2 around the turning fulcrum 36 at the front end 5*b* of the wippen 5.

The jack stop 33 has a jack button screw 32 and a jack button 31 provided at the rear end section of the jack button screw 32. In the non-pressing state of the key (the releasing state of the key), the jack 6 makes contact with the jack button 31, whereby the initial position of the jack 6 is restricted and can be adjusted with the jack button screw 32.

A shank flange 9 is fastened to a shank rail 10. A regulating button 25 is provided on a regulating rail 100 mounted on the shank rail 10 so as to be adjustable in height with respect thereto. A repetition screw 34 is provided at the lower section of the shank flange 9. The hammer 11 is disposed above the repetition lever 8. The front end section of the hammer shank 16 of the hammer 11 is pivotally supported by the shank flange 9 so as to be turnable around a turning center 13 in the up-down direction. A hammer wood 17 is mounted at the rear end of the hammer shank 16 serving as a free end. A hammer felt 18 is mounted at the upper end of the hammer wood 17. A hammer roller 14 is provided near the front end section of the hammer shank 16.

In the non-pressing state of the key, the repetition lever 8 receives the hammer roller 14 from below at the upper face of the front end section thereof, thereby restricting the hammer 11 to its initial position. On the other hand, at the rear end section of the repetition lever 8, a repetition lever button 15 is disposed so as to be adjustable in height. This button 15 makes contact with the upper face of the rear end section 5*a* of the wippen 5, whereby the turning of the repetition lever 8 in the counterclockwise direction is restricted and the repetition lever 8 is restricted to its initial position.

A slot 21 is formed at the front end section of the repetition lever 8. The vertical section 6*a* of the jack 6 is inserted into the slot 21, and the top end face 22 of the vertical section 6*a* is almost flush with the upper face of the repetition lever 8.

In the above-mentioned configuration, in a normal key pressing forward stroke in which the key K being in its non-pressing state is pressed, the wippen 5 is pushed up by the rising of the capstan screw 4 and is turned around the turning fulcrum 23 counterclockwise, that is, in the forward stroke direction thereof. Since the wippen 5 is pushed up, the repetition lever 8 and the jack 6 are turned upward together with the wippen 5. With the turning of these elements, first, the repetition lever 8 and the vertical section 6*a* of the jack 6 push up the hammer 11 via the hammer roller 14 while allowing the hammer roller 14 to rotate and slide, thereby turning the hammer 11 upward.

On the other hand, with the turning of the key K in the forward stroke direction, a damper lever cushion 68 provided at the upper section of the rear end section of the key K pushes up the front end section of the damper lever 67. As a result, the damper 79 is raised via the damper block 69 and then the damper 79 (strictly speaking, damper felts provided at the lower section of the damper 79) is separated from the string 19.

Next, when the repetition lever 8 makes contact with and is engaged with the repetition screw 34, the displacement (the upper limit position) of the repetition lever 8 in the counterclockwise direction is restricted. Hence, the top end face 22 of the vertical section 6*a* of the jack 6 protrudes while passing through the slot 21 of the repetition lever 8, whereby the hammer roller 14 is driven by the top end face 22 and the hammer 11 is pushed up.

When the wippen 5 is turned further in the forward stroke direction, the small jack 6*b* of the jack 6 makes contact with the lower face of the regulating button 25 (strictly speaking, the regulating button punching thereof) in the middle of the turning, and the rising of the small jack is stopped. However, since the wippen 5 itself is turned further, the jack 6 is turned clockwise around the turning fulcrum 36. Hence, the top end face 22 of the vertical section 6*a* of the jack 6 is moved away from the hammer roller 14 from the lower side to the front side and escapes therefrom. As a result, the hammer 11 is disengaged from the jack 6 and set to a free turning state, thereby striking the string 19. After striking the string, the hammer 11 is turned by its own weight and by the repulsion force of the string 19, thereby returning to its original position. However, in the silencing mode, the hammer shank 16 of the hammer 11 makes contact with the lower face of the silencing stopper 60, but does not make contact with the string 19.

When the key pressing state is maintained after the end of the key pressing operation, the hammer wood 17 of the hammer 11 bounced back by the string 19 is received by the back check 35 (strictly speaking, the back check cloth 35*a* thereof) and becomes stationary. When the key K is released and when the back check 35 is disengaged from the hammer 11, the repetition lever 8 is turned counterclockwise by the energizing force of a repetition energizing section 12*b*, and the hammer roller 14 is supported by the repetition lever 8.

Furthermore, after the string striking operation, as the wippen 5 is turned and returned to its original position, the jack 6 is released from the regulating button 25 and turned counterclockwise by the energizing force of a jack energizing section 12*a* and returned to its original position. Since the top end face 22 of the vertical section 6*a* of the jack 6 is returned quickly to the lower side position of the hammer roller 14, the next string striking operation can be carried out by pressing the key again, even if the key K is not returned completely to its non-pressing position. In other words, key pressing can be made quickly and repeatedly.

In the keyboard unit according to this embodiment, an element, the engagement state of which with an object to be engaged is changeable in the stroke of key pressing/releasing operation, is referred to as "a member." The member includes not only a single component but also component members configured as an integrated unit or members configured to be movable as an integrated unit. For example, the members correspond to the key K and the hammer 11, and also correspond to the elements intervened in the system ranging from the key K to the hammer 11 or elements for restricting the turning start positions and the turning stop positions of the key and the hammer 11. More specifically, in addition to the above-mentioned items, the elements designated by reference numerals 5, 6, 7, 8, 9, 11, 15, 19, 20, 25, 31, 34, 35, 60, 63, 65, 79, etc. can correspond to the members. The elements 64, 66 and 68 may be grasped as portions of the key K. The elements 14, 16, 17 and 18 may be grasped as portions of the hammer 11. The movable members other than the key K can correspond to displacement members. However, the members are not limited to these items taken as examples.

Some of the plurality of members exemplified above are, for example, disposed adjacently and engaged mutually in the stroke of key pressing/releasing operation. In particular, the combination of a "movable member" that is movable and a "corresponding member" that is engageable with the "movable member" is referred to as an "engaging set." The movable member is herein a member that is displaced by the key pressing/releasing operation, whereby the position and posture thereof are changed. The corresponding member may be movable.

For example, since the top end face 22 of the vertical section 6*a* of the jack 6 is engageable with the hammer roller 14 (strictly speaking, the hammer roller skin thereof) in the middle of the stroke of key pressing operation, the set composed of the jack 6 and the hammer 11 is an engaging set. Since both the jack 6 and the hammer 11 are movable, one of them can be grasped as a movable member and the other can be grasped as a corresponding member.

Furthermore, since the back rail cloth 65 makes contact with the conductive section 66 of the key K in the non-pressing state of the key and separates therefrom when the key is pressed, the set composed of the back rail cloth 65 and the key K is an engaging set. Since the damper lever cushion 68 can make contact with the contact section 67*a* of the damper lever 67 in the middle of key pressing operation, the set composed of the key K and the damper lever 67 is an engaging set. Moreover, since the small jack 6*b* of the jack 6 can make contact with the regulating button 25 (strictly speaking, the regulating button punching thereof), the set composed of the jack 6 and the regulating button 25 is an engaging set.

In addition to these, the set (FIG. 1) composed of the front punching cloths 63A and 63B and the key K having the front bushing cloths 64A and 64B, the set composed of the repetition lever button 15 and the wippen 5, and the set composed of the repetition screw 34 and the repetition lever 8 are each an engaging set. Furthermore, the set composed of the hammer 11 (more particularly, the portion 17*a* of the hammer wood 17 making contact with the back check cloth 35*a*) and the back check 35 (more particularly, the back check cloth 35*a* thereof), the set composed of the jack button 31 and the jack 6, and the set composed of the hammer 11 having the hammer shank 16 and the silencing stopper 60 are each an engaging set. Moreover, the set composed of the string 19 and the hammer felt 18 and the set composed of the string 19 and the damper 79 can each be an engaging set.

In this embodiment, a detector for detecting the state of the engagement between a movable member and a corresponding member constituting an engaging set is provided for each engaging set, and these detectors are provided for each key K. The detector detects the engaged state of the movable member and the corresponding member depending on the state of the electrical conduction between the engaged sections of the members engaged with each other. More specifically, each of the engaged sections is configured so as to have conductivity, and the detector detects the engaged state of the two by utilizing the fact that conduction occurs when the two make contact with each other and that non-conduction occurs when the two are separated from each other.

In order that the above-mentioned conduction configuration is attained easily, for example, conductive materials are provided in the regions of the engaged sections being engaged with each other. As a conductive material, graphite, conductive rubber, conductive nonwoven fabric, copper plate, conductive coating (conductive grease) or the like is provided on at least the surfaces or the engagement faces in the regions of the engagement. In the case that cloth or the like is used, the entire cloth may be formed of a conductive material. Alternatively, the whole or at least the respective engaged sections of the movable members and the corresponding members may be made of a conductor or a conductive material. For example, the whole or the engaged sections of the members are formed of resin. The configuration for giving conductivity may be different between the movable members and the corresponding members.

Some typical examples of the conductive configuration of each engaged section are taken as described below. Both the jack 6 and the hammer roller 14 are formed of conductors. Alternatively, in the jack 6, a conductive material may be provided on at least the top end face 22 of the vertical section 6*a*. Both the regulating button 25 and the jack 6 are formed of conductors. In the jack 6, the vertical section 6*a* and the small jack 6*b* may be formed into an integrated conductor or may be electrically insulated from each other. The back rail cloth 65 is made of a conductive cushioning material or the like, and the conductive section 66 is formed of a conductor.

It is sufficient that conductivity is provided only on required regions. For example, in the case of the hammer shank 16 to be engaged with the silencing stopper 60, only the region (upper side) of the hammer shank 16 being capable of making contact with the silencing stopper 60 may be configured so as to have conductivity. In the case of the damper lever 67, the contact section 67*a* thereof being capable of making contact with the damper lever cushion 68 may be configured so as to have conductivity.

The conductive sections having conductivity are electrically connected to the electric circuit boards. In FIG. 2, the electric circuit boards are not shown. As shown in FIG. 1, for example, the conductive section of the jack 6 is connected to an electric circuit board 62 with a wire 72, such as a flexible lead, and the hammer roller 14 is also connected to the electric circuit board 62 with a wire 73. Moreover, to the electric circuit board 61, the front bushing cloths 64A and 64B are connected with a wire 71, and the front punching cloths 63A and 63B are also connected with wires, not shown. The conductive sections of the other engaged sections are also connected as necessary to the electric circuit boards 61 and 62 or electric circuit boards, not shown, with wires.

In this embodiment, the engaged states of a plurality of engaging sets are detected by the detectors respectively corresponding thereto, whereby musical sound control can be carried out on the basis of the detection results of the detectors. Furthermore, the detection results are used for not only musical sound control, but also the recording of performance as performance data for musical sound control. Moreover, the detection results are also used for the output of performance data to an external device. Although the engaging sets for musical sound control and the recording of performance data are not limited in quantity, a configuration formed of four engaging sets is taken as a representative example in this embodiment.

First, the set composed of the jack 6 (the top end face 22 thereof) and the hammer 11 (the hammer roller 14 thereof) is assumed to be a first set. The set composed of the key K (the damper lever cushion 68 thereof) and the damper lever 67 (the contact section 67*a* thereof) is assumed to be a second set. The set composed of the regulating button 25 and the jack 6 (the small jack 6*b* thereof) is assumed to be a third set. The set composed of the back rail cloth 65 and the lower face (the conductive section 66 thereof) of the key K is assumed to be a fourth set. The detector in each engaging set is referred to as a detection section SW. For example, the detectors respectively corresponding to the first, second, third and fourth sets are referred to as detection sections SW1, SW2, SW3 and SW4. These detection sections SW turn ON when they become conductive and turn OFF when they become non-conductive. For example, the detection section SW1 turns ON when the top end face 22 of the jack 6 makes contact with the hammer roller 14 of the hammer 11 and the detection section SW1 turns OFF when they separate from each other.

Figures 3A, 3B:
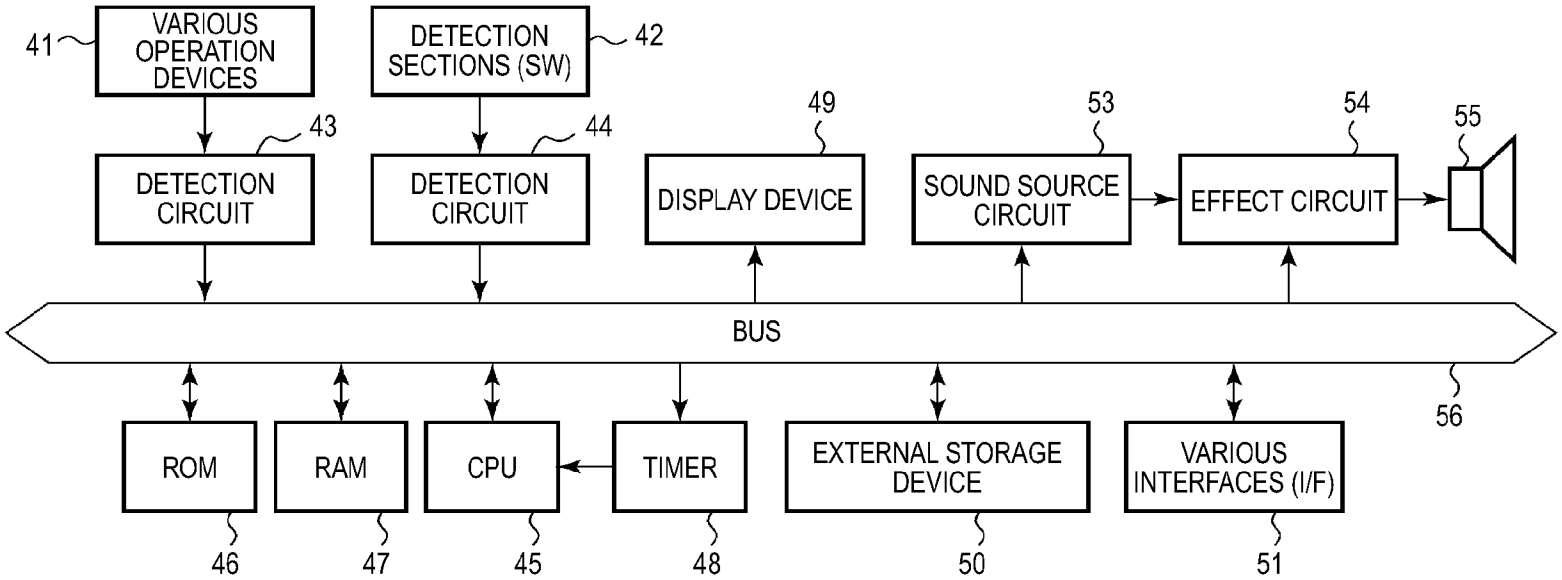
FIG. 3A is a block diagram showing the whole configuration of the keyboard unit.
FIG. 3B is a conceptual drawing indicating the information of the detection results in the detection sections, the information being stored in a register.

FIG. 3A is a block diagram showing the whole configuration of the keyboard unit. The keyboard unit has a configuration in which a detection circuit 43, a detection circuit 44, a ROM 46, a RAM 47, a timer 48, a display device 49, an external storage device 50, various interfaces (I/F) 51, a sound source circuit 53, and an effect circuit 54 are respectively connected to the CPU 45 via a bus 56.

Furthermore, the detection sections 42 are connected to the detection circuit 44. Various operation devices 41 include playing operation devices, such as the key K. The detection sections 42 correspond to the conductive sections of the respective engaging sets in the above-mentioned plurality of detection sections SW. The timer 48 is connected to the CPU 45, and a sound system 55 is connected to the sound source circuit 53 via the effect circuit 54.

The detection circuit 43 detects the operation states of the various operation devices 41. The detection circuit 44 detects the conduction states of the detection sections SW and supplies the results of the detection to the CPU 45. The CPU 45 controls the whole unit. The ROM 46 stores control programs to be executed by the CPU 45, various table data, etc. The RAM 47 temporarily stores various input information, such as performance data and text data, various flags, buffer data, operation results, etc. The timer 48 counts an interruption time in timer interruption processing and various times. The various interfaces (I/F) 51 include a MIDI interface and a communication interface. The sound source circuit 53 converts performance data having been input from the various operation devices 41 and the detection sections 42, preset performance data, etc. into musical sound signals. The effect circuit 54 gives various effects to musical sound signals to be input from the sound source circuit 53, and the sound system 55 including a DAC (digital-to-analog converter), an amplifier, speakers, etc. converts musical sound signals and the like to be input from the effect circuit 54 into sound.

FIG. 3B is a conceptual drawing indicating the information of the detection results in the detection sections SW, the information being stored in a register inside the RAM 47. The information of the detection results in the detection sections SW is information indicating ON/OFF conduction states and change times when ON/OFF switching has occurred, and the information for all the detection sections SW is stored in the register of the RAM 47 for each key K.

Figure 4:
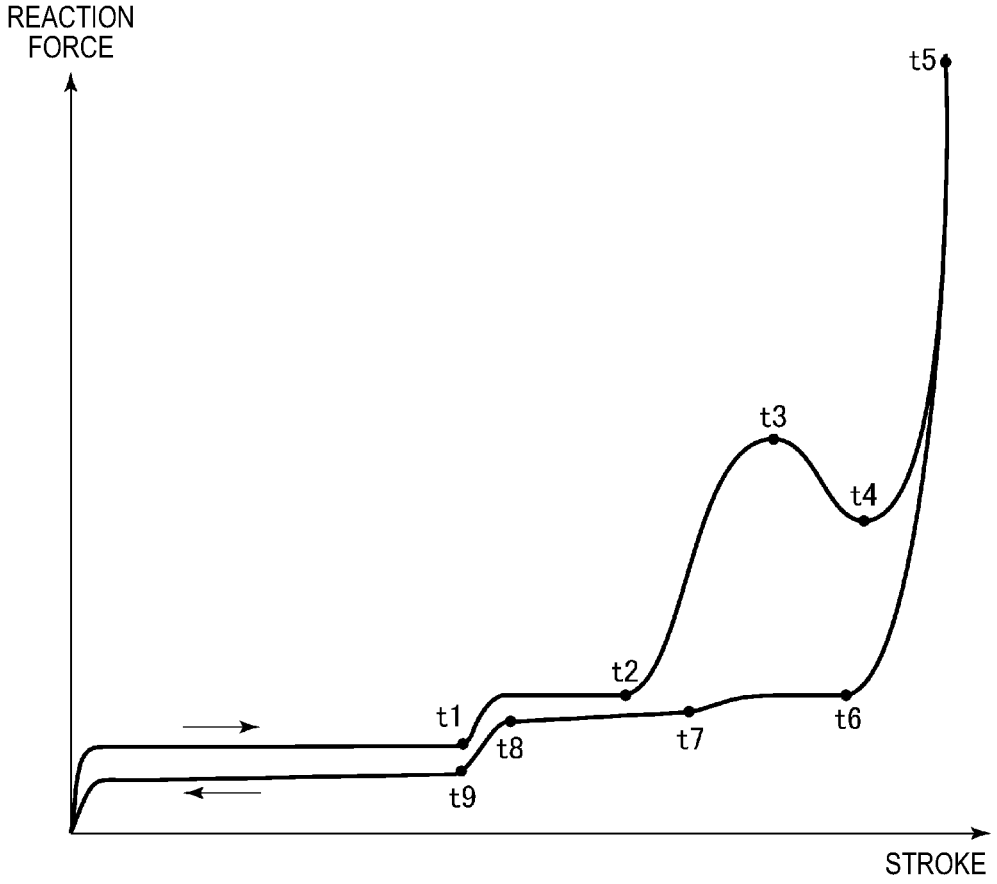
FIG. 4 is a graph showing the change in a reaction force with respect to the stroke of key pressing operation during normal key pressing/releasing operation.

FIG. 4 is a graph showing the change in a reaction force with respect to the stroke of key pressing operation during normal key pressing/releasing operation. The mode during the normal key pressing/releasing operation is the operation mode most frequently used. In the mode, the key is pressed to its end position with a moderate strength and then released to its rest position.

First, when the key pressing operation is started from the rest position in the forward stroke of the key pressing operation, the back rail cloth 65 is separated from the conductive section 66 of the key K, and the reaction force increases abruptly. The start timings of the key pressing operation can be grasped by using the detection result (ON to OFF) of the detection section SW4.

At time t1, the separation of the damper 79 from the string 19 starts, and the contact pressure between them begins to decrease gradually. This timing is the timing at which the key K begins to push up the damper lever 67 and can be grasped as the contact timing between the damper lever cushion 68 and the contact section 67*a* of the damper lever 67 on the basis of the detection result (OFF to ON) of the detection section SW2. In the silencing mode, for example, expressing power can be improved by reflecting resonance sound by using the detection result of the detection section SW2.

Next, at time t2, the regulating button 25 makes contact with the jack 6 (the small jack 6*b* thereof), and the jack 6 begins to turn clockwise in FIG. 2 with respect to the wippen 5. This timing can be grasped on the basis of the detection result (OFF to ON) of the detection section SW3. Furthermore, the repetition lever 8 makes contact with the repetition screw 34 almost simultaneously with the turning. For example, the start of the so-called double escapement motion carried out by the jack 6 and the repetition lever 8 can be grasped by using the detection results of the detection sections including the detection section SW3. Since the motions of the jack 6 and the repetition lever 8 are synchronized with the motion of the key K, the turning position of the key K can also be grasped eventually.

Next, time t3 corresponds to the timing at which the jack 6 begins to come off from the hammer roller 14. The contact pressure between the regulating button 25 and the jack 6 becomes maximal at this timing. At the time after time t3 and before time t4, the jack 6 is separated from the hammer roller 14. The timing of this separation can be grasped by using the detection result (ON to OFF) of the detection section SW1. Time t4 corresponds to the timing immediately after the coming-off of the jack 6 from the hammer roller 14. The front bushing cloths 64A and 64B make contact with the front punching cloths 63A and 63B and the braking of the key K starts, and the hammer 11 is normally in the middle of the returning motion after striking the string 19. Next, at time t5, the key K is in the state of being pressed completely, that is, in its end state.

Next, in the returning stroke of the key pressing operation, time t6 corresponds to the timing at which the separation of the regulating button 25 from the jack 6 starts, and the timing can be grasped by using the detection result (ON to OFF) of the detection section SW3. At time t7, the repetition lever 8 separates from the repetition screw 34. Since the jack 6 has returned mechanically to a position lower than the hammer roller 14 at this timing, it can be construed that the key K is in a state of being ready for repeated key pressing operation while being not allowed to return to the rest position. Hence, natural expression can be attained by detecting the timing and by using the timing for the determination of the velocity and sound generation trigger in the musical sound control in the silencing mode. In other words, the problem encountered in the related art, that is, sound is not generated although the player can feel positive response to playing, can be solved.

Next, at time t8, the damper 79 starts making contact with the string 19, and the contact pressure therebetween begins to rise gradually. In the case that the string is vibrating, the vibration begins to be attenuated. In the silencing mode, the start of silencing, resonance sound, etc. can be controlled by using the detection result of the detection section SW2. Next, at time t9, the damper 79 completely makes contact with the string 19 and sound is silenced. This timing can be grasped on the basis of the detection result (ON to OFF) of the detection section SW2 as the timing at which the damper lever cushion 68 separates from the contact section 67*a* of the damper lever 67. The key returns to the rest position.

By the way, various key pressing modes being different in the strength (speed) and depth of key pressing operation are available in addition to the normal key pressing mode. For example, staccato is available as an operation mode in which sound is generated although the key is not pressed to the end position. Hence, musical sound control using the detection results of the detection sections SW1 to SW4 will be described below as an example referring to FIGS. 5A to 6.

Figure 5A:
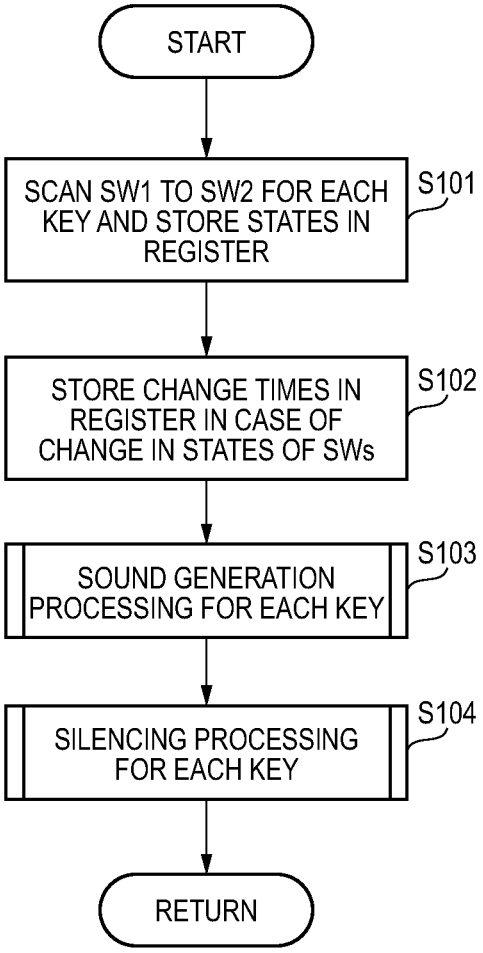
FIG. 5A is a flowchart showing main processing.

FIG. 5A is a flowchart showing main processing. This processing is executed at predetermined intervals (for example, every 100 μsec). First, the CPU 45 scans the detection sections SW1 to SW4 for each key K and stores the results (conductive states, that is, ON or OFF) of the scanning in the register for each key K (at step S101). Next, in the case that the conduction states of the detection sections SW have changed, the CPU 45 also stores the change times of the states (at step S102). Hence, the information (FIG. 3B) on the results of the detection is stored for each key K and renewed as necessary. The processing for scanning the detection sections SW and the processing for storing the states in the register may also be carried out sequentially and automatically by hardware.

Next, the CPU 45 carries out the sound generation processing (FIG. 6) for each key K (at step S103), and then carries out silencing processing (FIG. 5B) for each key K (at step S104), thereby ending the processing shown in FIG. 5A.

Figure 5B:
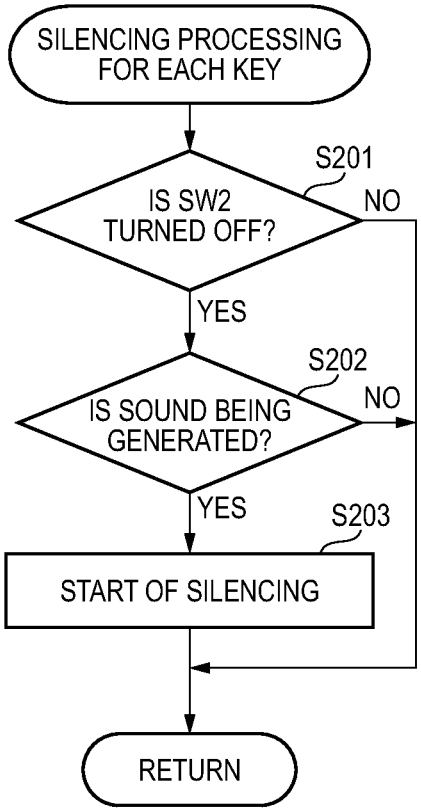
FIG. 5B is a flowchart showing silencing processing for each key.
Figure 6:
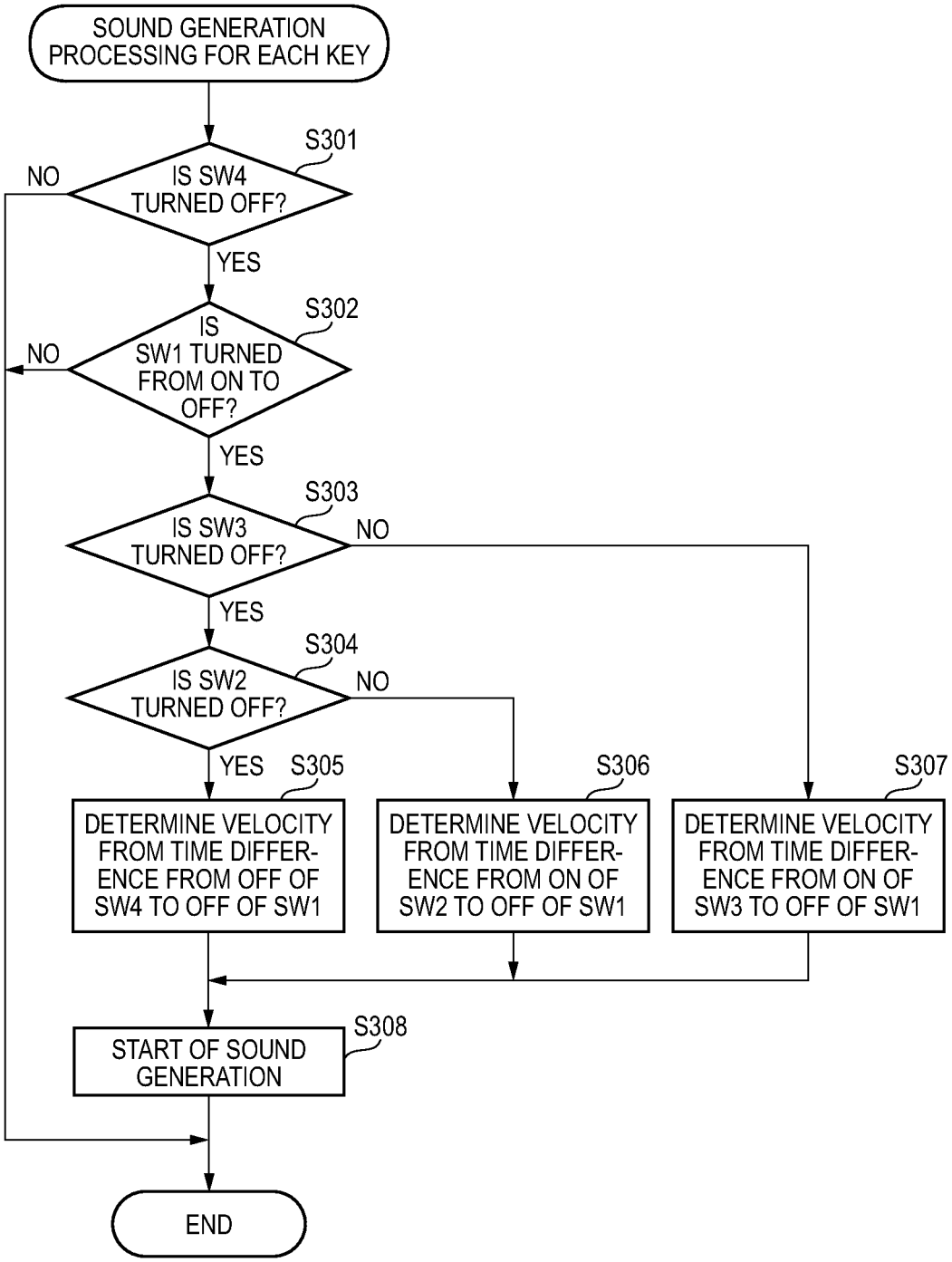
FIG. 6 is a flowchart showing sound generation processing for each key.

FIG. 5B is a flowchart showing the silencing processing for each key K to be executed at step S104 in FIG. 5A. FIG. 6 is a flowchart showing sound generation processing for each key K to be executed at step S103 in FIG. 5A.

First, at step S301 in FIG. 6, the CPU 45 judges whether the state of the detection section SW4 is OFF. This judgment is made referring to the information (FIG. 3B) of the results of the detection and also made similarly at the following steps. In the case that the state of the detection section SW4 is OFF as the result of the judgment, it can be judged that the back rail cloth 65 is separated from the conductive section 66 of the key K and that this state is a state in which the key K is pressed even just a little bit, and the CPU 45 advances the processing to step S302. On the other hand, in the case that the state of the detection section SW4 is ON, it can be judged that the key is in the rest state, whereby the processing shown in FIG. 6 ends without sound generation.

At step S302, the CPU 45 judges whether the state of the detection section SW1 has changed from ON to OFF. In the case that the state of the detection section SW1 has changed from ON to OFF as the result of the judgment, it is construed that the jack 6 has separated from the hammer roller 14, the processing proceeds to step S303. This is because the large jack always separates from the hammer roller skin when the hammer strikes the string also in an acoustic piano, and in such a case, the processing is required to proceed to sound generation processing. Accordingly, the sound generation trigger (sound generation timing) is determined by the change of the state of the detection section SW1 from ON to OFF. On the other hand, in the case that the state of the detection section SW1 has not changed from ON to OFF, it is not necessary to generate sound, and the processing shown in FIG. 6 ends.

At step S303, the CPU 45 judges whether the state of the detection section SW3 is OFF. In the case that the state of the detection section SW3 is ON as the result of the judgment, it is construed that the jack 6 (the small jack 6*b* thereof) is in contact with the regulating button 25, and the CPU 45 judges that the state corresponds to the normal key pressing state and advances the processing to step S307. At step S307, the CPU 45 determines the key pressing velocity of the key on the basis of the time difference between the ON state of the detection section SW3 and the OFF state of the detection section SW1. Next, at step S308, sound generation starts. In other words, the CPU 45 controls the sound source circuit 53, the effect circuit 54, etc. so that the musical sound having the sound pitch of the key K to be processed in this processing is generated at the velocity currently determined for the key K.

On the other hand, in the case that the state of the detection section SW3 is OFF as the result of the judgment at step S303, it is construed that the regulating button 25 is separated from the jack 6, and the CPU 45 advances the processing to step S304. In this case, since the detection section SW1 is OFF although the detection section SW3 is OFF, it can be judged that the mode is not the normal key pressing mode but that the key is in a state of being pressed to play staccato or the like. In other words, in the case that staccato or the like is played, the jack 6 or the repetition lever 8 strongly raises the hammer roller 14, whereby the hammer 11 is turned in the forward stroke direction while the regulating button 25 is not made contact with the jack 6. Hence, it is appropriate to carry out control different from the control for the normal key pressing operation.

At step S304, the CPU 45 judges whether the state of the detection section SW2 is OFF. In the case that the state of the detection section SW2 is ON as the result of the judgment, it is construed that the damper lever cushion 68 is in contact with the damper lever 67 (the contact section 67*a* thereof). In this case, it can be judged that the key is in a state of being pressed to a certain extent of depth although the key is pressed to play staccato or the like. Hence, at step S306, the CPU 45 determines the key pressing velocity on the basis of the time difference between the ON state of the detection section SW2 and the OFF state of the detection section SW1. The processing then proceeds to step S308 and sound generation starts.

On the other hand, in the case that the state of the detection section SW2 is OFF as the result of the judgment at step S304, it is construed that the damper lever cushion 68 is separated from the damper lever 67 (the contact section 67*a* thereof). In this case, it can be judged that extreme staccato is played in which the key is pressed strongly with a short stroke. The hammer 11 makes contact with the string 19 or the silencing stopper 60 while the damper 79 is not separated from the string 19. Hence, at step S305, the CPU 45 determines the key pressing velocity on the basis of the time difference between the OFF state of the detection section SW4 and the OFF state of the detection section SW1. The processing then proceeds to step S308 and sound generation starts.

The above descriptions can be summarized as described below. In the case of normal key pressing operation, the detection section SW3 turns ON and then the detection section SW1 turns OFF. Hence, the key pressing velocity is determined on the basis of the time difference between the ON state of the detection section SW3 and the OFF state of the detection section SW1. In the case that staccato or the like is played, the detection section SW3 and the detection section SW2 do not turn ON in some cases. Hence, in the case that the detection section SW2 turns ON, the key pressing velocity is determined on the basis of the time difference between the ON state of the detection section SW2 and the OFF state of the detection section SW1. In the case that extreme staccato is played, even the detection section SW2 does not turn ON in some cases. In that case, the key pressing velocity is determined on the basis of the time difference between the OFF state of the detection section SW4 and the OFF state of the detection section SW1.

Rightfully speaking, the time difference between the ON state of the detection section SW3 and the OFF state of the detection section SW4 is desired to be used because it is desired that the velocity should be calculated from the state immediately before the hammer 11 finally strikes the string 19. However, the detection section SW3 does not turn ON in some cases. For this reason, the detection results of the detection sections to be adopted for the determination of the key pressing velocity are determined on the basis of the detection results of the detection sections SW2, SW3 and SW4.

In the example shown in FIG. 6, any one of three sets, that is, second, third and fourth sets, corresponding to the detection sections SW2, SW3 and SW4, are determined as a set for determining the key pressing velocity. However, any two of the second, third and fourth sets may also be determined as sets for determining the key pressing velocity. Furthermore, the sets are not limited to the four sets shown as examples in FIGS. 5A to 6, but other engaging sets may also be used for the judgment. In other words, the detection results of the other sets of detection sections SW may also be combined appropriately and used for musical sound control and recording of performance data. Processing to be carried out by using the detection results of the detection sections SW may merely include at least the processing for determining musical sound parameters for musical sound control. The key pressing velocity serving as a kind of musical sound parameter to be determined is taken just as an example, and another parameter may also be determined or another parameter in addition to the key pressing velocity may be determined. Moreover, the processing is not required to be carried out up to sound generation processing, and performance data may be used only for recording as described above or may be output to an external device.

In the silencing processing of each key K shown in FIG. 5B, at step S201, the CPU 45 judges whether the state of the detection section SW2 is OFF. In the case that the state of the detection section SW2 is ON as the result of the judgment, it is construed that the damper lever cushion 68 is in contact with the damper lever 67 (the contact section 67*a* thereof). In this case, the damper 79 is separated from the string 19, whereby the CPU 45 ends the processing shown in FIG. 5B without starting silencing.

On the other hand, in the case that the state of the detection section SW2 is OFF, since the damper 79 is in contact with the string 19, the CPU 45 advances the processing to step S202 and judges whether the musical sound having the sound pitch corresponding to the key K to be processed in this processing is being generated. In the case that the musical sound is not being generated as the result of the judgment, the CPU 45 ends the processing shown in FIG. 5B. On the other hand, in the case that the musical sound is being generated, the CPU 45 starts silencing of the musical sound being generated (at step S203).

However, in the case that sound generation has been carried out via step S305 in FIG. 6, it is immediately judged at step S201 in FIG. 5B that the state of the detection section SW2 is OFF and silencing starts. This kind of state corresponds to a state in which only the hammer 11 moves freely and strikes the string while the damper is in a state of not being raised in an acoustic piano. In other words, the string is in a state of being pressed with the damper when the string is struck by the hammer. Hence, the vibration of the string does not last long but is silenced immediately. Hence, it makes sense that the silencing processing is carried out immediately after the sound generation processing.

In this embodiment, engaged sections in which a movable member and a corresponding member constituting an engaging set are engaged with each other are configured so as to be electrically conductive, the engaged state of the two is detected depending on the electrical conduction between the engaged sections, and musical sound parameters for musical sound control are determined on the basis of the result of the detection. Hence, unlike the structure of the sensors made of rubber, the leaf switches or the like according to the related art in structure, the movable member and the corresponding member do not generate a special reaction force during the key pressing operation when the timing of the contact between the movable member and the corresponding member is detected. Hence, the musical sound parameters can be determined while the influence to be exerted on the feeling of pressing the key is reduced and the state of playing operation is estimated accurately. Furthermore, since the detection result is reflected to the musical sound control, a feeling of difference between the feeling of pressing the key and the timing of sound generation is eliminated, and natural musical sound corresponding to the mode of playing is generated.

Although the state of playing operation is estimated by detecting the conduction states of the four sets in this embodiment, the number of the sets for use in the estimation may merely be one or more. As the number of the sets is larger, the reliability of the estimation becomes higher.

The engaging sets having been described above so far are configured so as to detect whether the detection sections SW are ON or OFF. However, the engaging set is not limited to have this configuration, but may be configured so as to detect the change in the engaged state of the movable member and the corresponding member at a plurality of steps or continuously depending on the state of electrical conduction between the engaged sections and to use the result of the detection, for example, for musical sound control. A modification of this kind is shown in FIGS. 7A to 7C.

Figure 7A:
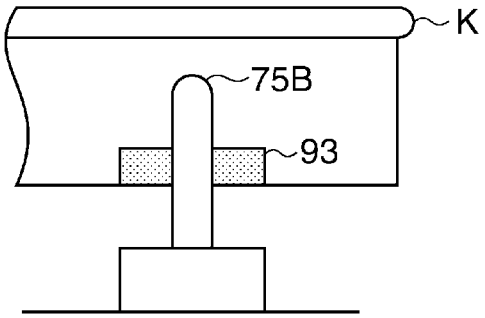
FIGS. 7A to 7C are views showing conductive configurations according to modifications.

For example, as shown in FIG. 7A, at the front section of the key K, a guide bushing 93 to be engaged with the front pin 75B is formed of a conductor. The front pin 75B is made of carbon and configured so as to function as a variable resistor. The engagement position of the guide bushing 93 with respect to the front pin 75B changes relatively depending on the depth of key pressing operation. Hence, the resistance value of the resistor in the state of the conduction between the two is changed continuously by key pressing operation, whereby a signal depending on the depth of key pressing operation can be obtained. The front pin 75A can also be assumed so as to be configured similarly to the front pin 75B.

Figure 7B:
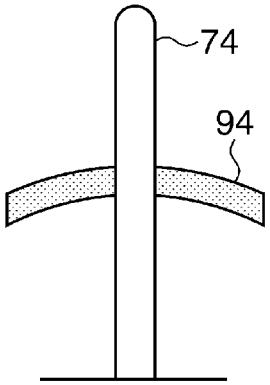

Alternatively, as shown in FIG. 7B, the balance pin 74 of the key fulcrum section 70 (FIG. 1) is formed of a conductor, and a balance bushing cloth 94 is configured so as to function as a variable resistor. The engagement position of the balance pin 74 with respect to the balance bushing cloth 94 is changed relatively by the swinging of the key K during key pressing operation. Hence, a signal depending on the depth of key pressing operation can be obtained.

Figure 7C:
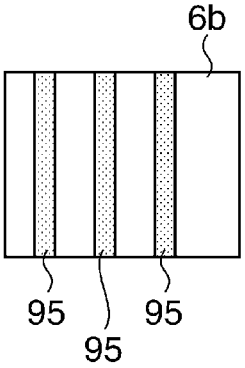

In addition, as shown in FIG. 7C, a plurality of strip-shaped conductive sections 95 made of graphite or the like may be provided on the curved face of the small jack 6*b* of the jack 6 opposed to the regulating button 25. The conductive sections 95 are separated from each other so as to be insulated electrically. Since the jack 6 is rotated in the stroke of key pressing/releasing operation, the position of the small jack 6*b* making contact with the regulating button 25 is changed gradually. Hence, the rotation position of the jack 6 can be grasped at a plurality of steps by detecting the state of the conduction between the regulating button 25 and the conductive section 95 which is included in one of the plurality of conductive sections 95 and with which the regulating button 25 actually makes contact.

Such a variable resistor and a plurality of strip-shaped conductive sections can also be applied to not only the above-mentioned engaging sets but also an engaging set in which the engagement position of a member changes depending on the sliding displacement or the rotation displacement thereof with respect to the other member to be engaged therewith. Since, the change in the state of the engagement is detected at a plurality of steps or continuously, the state of playing operation can be estimated more accurately.

Figure 8:
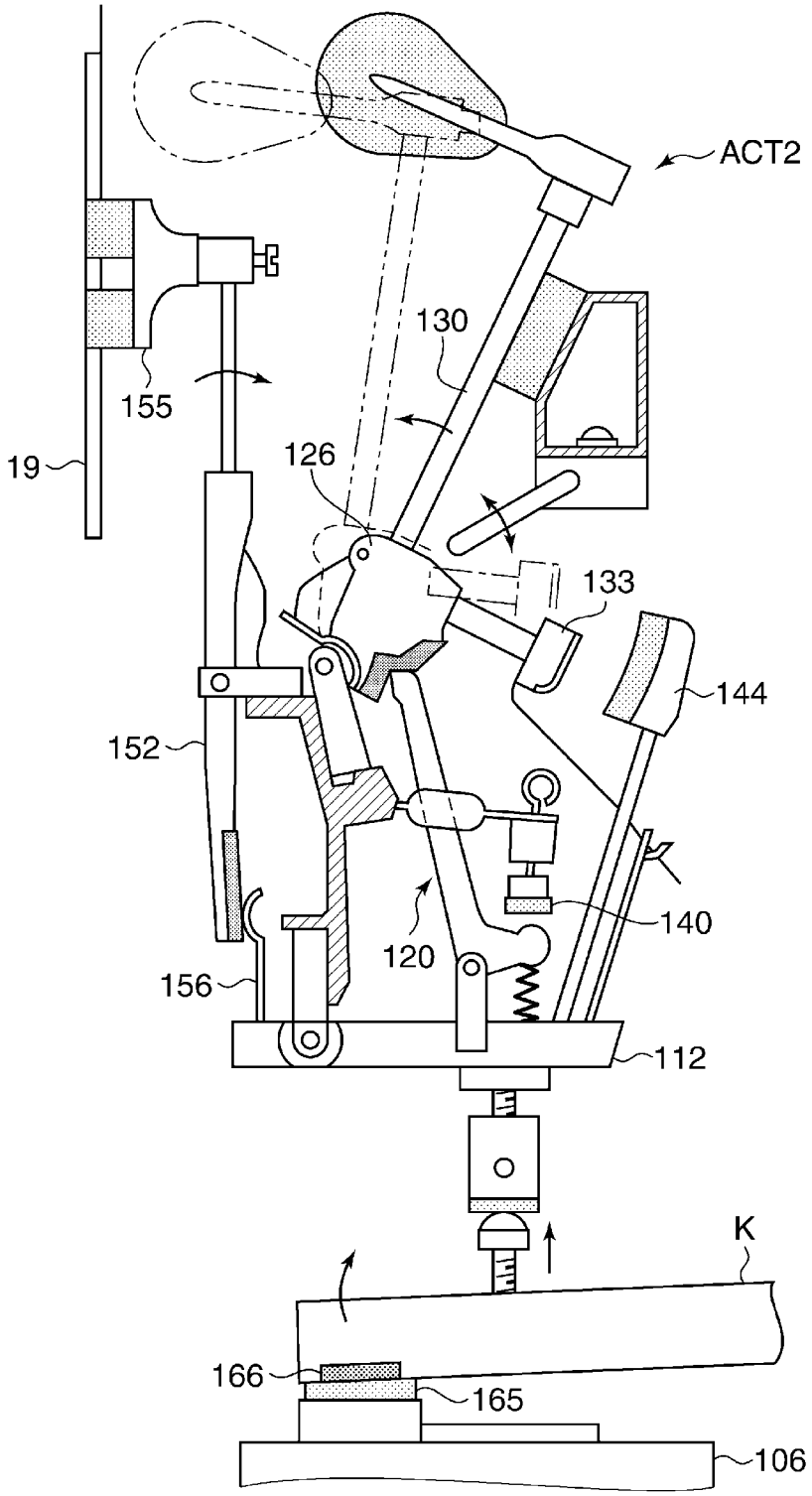
FIG. 8 is a side view showing the action mechanism of an upright piano.

Furthermore, in this embodiment, although application of the keyboard unit according to the present invention to the keyboard musical instrument having the grand piano type action mechanism ACT is taken as an example, the configuration of the keyboard unit according to the present invention is not limited to such a configuration having the action mechanism ACT. In other words, the keyboard unit according to the present invention is applicable to a keyboard musical instrument in which a hammer is driven by the pressing operation of a key and the hammer does not operate in synchronization with the key in the stroke of key pressing/releasing operation in some cases. Moreover, the keyboard unit according to the present invention is also applicable to a keyboard musical instrument having an upright type action mechanism ACT shown in FIG. 8. Alternatively, the keyboard unit according to the present invention is also applicable to an electronic keyboard musical instrument having an action mechanism ACT but having no string FIG. 8 is a side view showing the action mechanism ACT2 of an upright piano. In normal key pressing operation, when the key K is pressed down, a wippen 112 is pushed up and turned, whereby a jack 120 is raised. When the jack 120 is raised, a bat 126 is pushed up by the jack 120, whereby a hammer 130 is turned counterclockwise as shown in FIG. 8. The jack 120 is raised and turned. In the middle of being raised and turned, the jack 120 makes contact with a regulating button 140 and is turned clockwise, thereby escaping temporarily from the lower section of the bat 126. Moreover, when the wippen 112 is raised and turned, a damper spoon 156 turns a damper lever 152 clockwise, whereby a damper 155 is separated from the string 19.

After the damper 155 is separated from the string 19, the hammer 130 strikes the string 19. The hammer 130 is then bounced back, and a catcher 133 is elastically received by a back check 144. The jack 120 is released from the regulating button 140 by the turning and lowering of the wippen 112 accompanied by key releasing operation, whereby the jack 120 is turned and then returned to its original position, and the upper end of the jack 120 again enters the lower section of the bat 126. Hence the next string striking operation can be carried out using the same key K.

A key back rail cloth 165 is disposed so as to be fastened to a shelf board 106, and a conductive section 166 is provided at the rear lower section of the key K.

In the above-mentioned configuration, for example, the set of the bat 126 and the jack 120, the set of the regulating button 140 and the jack 120, and the set of the lower face (the conductive section 166 thereof) of the key K and the key back rail cloth 165 are construed as engaging sets. Also in the configuration shown in FIG. 8, a member corresponding to the silencing stopper 60 may be provided.

According to an aspect of the present invention, the musical sound parameters can be determined by accurately estimating the state of playing operation while the influence to be exerted on the feeling of pressing the key is reduced.

In the invention, each of the engaged sections of the movable member and the corresponding member in the set corresponding to the at least one of the first and second detectors may be made of a conductive material or an engaged region of each of the engaged sections may be provided with a conductive material. In this case, the configuration is simple.

In the invention, the determiner may be configured to determine the musical sound parameter based on a timing of change in the engaged state of the movable member and the corresponding member in the first set detected by the first detector and a timing of change in the engaged state of the movable member and the corresponding member in the second set detected by the second detector. In this case, the musical sound parameters can be determined by further accurately estimating the state of playing operation.

In the invention, the second set may include at least two sets selected from among a set including the key and a back rail cloth, a set including the key having a damper lever cushion and a damper lever, and a set including a jack and a regulating button, the determiner may be configured to determine a key pressing velocity based on the detection result of the first detector and the detection result of the second detector, and the determiner may be configured to determine one of the at least two sets as a set to be used for determining the key pressing velocity based on a detection result of an engaged state of a movable member and a corresponding member of each of the at least two sets detected by the second detector. In this case, the sound generation trigger and the key pressing velocity can be determined by accurately estimating the state of playing operation.

In the invention, an engagement position between the engaged sections of the movable member and the corresponding member in the set corresponding to the at least one of the first and second detectors may change depending on a relative position between the movable member and the corresponding member, and the at least one of the first and second detectors may detect change in the engaged state of the movable member and the corresponding member at a plurality of steps or continuously depending on the state of electrical conduction between the engaged sections. In this case, the state of playing operation can be estimated further accurately.

Although the present invention has been described above on the basis of the preferred embodiment thereof, the present invention is not limited to the specific embodiment, but various embodiments within the scope not departing from the gist of the present invention are also included in the present invention.

What is claimed is:

1. A keyboard unit comprising:

a key;

a plurality of component members and a hammer, as engageable members where an engagement state of the engageable members engageable with each other is changeable in at least one of a pressing stroke or a releasing stroke of the key, the hammer being driven by the pressing stroke of the key;

a first detector for a first set, from among the key and the engageable members, including:

a first movable member; and a first corresponding member engageable with the first movable member, wherein the first movable member and the first corresponding member engage and come in contact with each other at first engagement sections thereof, and wherein the first detector is configured to detect the engagement state of the first movable member and the first corresponding member;

a second detector for a second set, from among the key and the engageable members, different from the first set and including:

a second movable member; and a second corresponding member to be engageable with the second movable member, wherein the second movable member and the second corresponding member engage and come in contact with each other at second engagement sections thereof, and wherein the second detector is configured to detect the engagement state of the second movable member and the second corresponding member; and a processor configured to implement instructions stored in a memory and perform a determining task that determines a musical sound parameter for musical sound control based on a first detection result of the first detector and a second detection result of the second detector, wherein at least the first engagement sections each are electrically conductive, and wherein the first detector detects the engagement state of the first movable member and the first corresponding member based on a state of electrical conduction between the first engagement sections.

2. The keyboard unit according to claim 1, wherein each of the first and second engagement sections is composed of a conductive material or has an engagement region provided with a conductive material.

3. The keyboard unit according to claim 1, wherein the processor is configured to determine the musical sound parameter based on a timing of change in the engagement state of the first movable member and the first corresponding member detected by the first detector and a timing of change in the engagement state of the second movable member and the second corresponding member detected by the second detector.

4. The keyboard unit according to claim 2, wherein:

an engagement position between at least one of the first or second engagement sections changes depending on a relative position between the respective first or second movable member and the respective first or second corresponding member, and one of the first or second detector detects a change in the engagement state of the respective first or second movable member and the respective first or second corresponding member at a plurality of steps or continuously depending on the state of electrical conduction between the respective first or second engagement sections.

5. The keyboard unit according to claim 1, wherein one of the first or second set includes a jack and a hammer roller.

6. The keyboard unit according to claim 1, wherein one of the first or second set includes the key and a back rail cloth.

7. The keyboard unit according to claim 1, wherein one of the first or second set includes the key and a damper lever cushion.

8. The keyboard unit according to claim 1, wherein one of the first or second set includes a jack and a regulating button.

9. The keyboard unit according to claim 1, wherein one of the first or second set includes a front punching cloth and a front bushing cloth.

10. The keyboard unit according to claim 1, wherein one of the first or second set includes a repetition lever button and a wippen.

11. The keyboard unit according to claim 1, wherein one of the first or second set includes a repetition screw and a repetition lever.

12. The keyboard unit according to claim 1, wherein one of the first or second set includes a hammer and a back check.

13. The keyboard unit according to claim 1, wherein one of the first or second set includes a jack button and a jack.

14. The keyboard unit according to claim 1, wherein one of the first or second set includes a hammer and a silencing stopper.

15. The keyboard unit according to claim 1, wherein one of the first or second set includes a string and a hammer felt.

16. The keyboard unit according to claim 1, wherein one of the first or second set includes a string and a damper.

17. The keyboard unit according to claim 1, wherein one of the first or second set includes a bat and a jack.

18. The keyboard unit according to claim 1, wherein one of the first or second set includes the key and a key back rail cloth.

19. The keyboard unit according to claim 1, further comprising:

a third detector for a third set, from among the key and the engageable members, different from the first and second sets and including:

a third movable member; and a third corresponding member engageable with the third movable member, wherein the third movable member and the third corresponding member engage and come in contact with each other at third engagement sections thereof, and wherein the third detector is configured to detect the engagement state of the third movable member and the third corresponding member; and a fourth detector for a fourth set, from among the key and the engageable members, different from the first, second, and third sets and including:

a fourth movable member; and a fourth corresponding member engageable with the fourth movable member, wherein the fourth movable member and the fourth corresponding member engage and come in contact with each other at fourth engagement sections thereof, and wherein the fourth detector is configured to detect the engagement state of the fourth movable member and the fourth corresponding member, wherein the processor is configured to determine the musical sound parameter depending on at least one of the first, second, third, or fourth set where the engagement state thereof has changed.

20. A keyboard unit comprising:

a key;

a hammer; and a plurality of members, including the key and the hammer, that cause the hammer to be moved, and each having an engagement section that is engageable with another engagement section of another member, among the plurality of members, so that the engagement section and the another engagement section come into contact with each other, an engagement state thereof being changeable by a movement of the key and at least a pair of engagement sections that come into contact with each other having a conductive portion;

a detector configured to detect the engaged state of the pair of engagement sections by detecting a conduction state between the conductive portions of the pair of the engagement sections that are in contact with each other; and a processor configured to implement instructions stored in a memory and perform a determining task that determines a musical sound parameter based on a detection result of the detector.

* * * * *